United States Patent [19]

Takeuchi

[11] 4,239,000

[45] Dec. 16, 1980

[54] SELECTIVELY BLOCKED MATRIX-FORM STENCIL AND METHOD OF USE

[75] Inventor: Sinya Takeuchi, Kobe, Japan

[73] Assignee: Kobe Steel, Limited, Kobe, Japan

[21] Appl. No.: 919,919

[22] Filed: Jun. 28, 1978

[30] Foreign Application Priority Data

Jul. 5, 1977 [JP] Japan ..... 52-80729
Jul. 5, 1977 [JP] Japan ..... 52-80730

[51] Int. Cl.[3] ..... B41M 1/12

[52] U.S. Cl. ..... 101/129; 101/112; 101/114; 118/666; 118/73; 118/301

[58] Field of Search ..... 101/35, 48–51, 101/112, 114, 127, 128, 129; 118/73, 5, 301, 302, 504; 427/282, 287, 300, 327, 421; 35/28; 164/267, 414

[56] References Cited

U.S. PATENT DOCUMENTS

| | | | |
|---|---|---|---|
| 2,884,853 | 5/1959 | Cantoni | 101/112 |
| 3,007,396 | 11/1961 | Govan | 101/42 |
| 3,011,433 | 12/1961 | Coakley | 101/115 X |
| 3,143,960 | 8/1964 | Nacqynski | 101/121 |
| 3,205,855 | 9/1965 | Ault | 118/49 |
| 3,277,818 | 10/1966 | Cone | 101/92 |
| 3,434,865 | 3/1969 | Doquire | 101/114 |
| 3,521,558 | 7/1970 | Fisher | 101/114 |
| 3,545,376 | 12/1970 | Francis | 101/121 |
| 3,584,571 | 6/1971 | Schmoll | 101/1 |
| 3,865,031 | 2/1975 | Ku | 101/114 |
| 3,892,174 | 7/1975 | Marcher | 101/35 |
| 3,915,216 | 10/1975 | Fekete | 164/414 |
| 3,943,848 | 3/1976 | Watanabe | 101/114 |
| 4,036,128 | 7/1977 | Easton | 101/9 |
| 4,066,807 | 1/1978 | Craig | 101/114 |
| 4,068,583 | 1/1978 | Sato | 101/93.04 |
| 4,106,435 | 8/1978 | Woodhouse | 118/301 |

OTHER PUBLICATIONS

IBM Technical Disclosure Bulletin; vol. 20, No. 1; Jun. 1977; pp. 440–442; Ronay M.; Matrix Screen Printer.

*Primary Examiner*—Edward M. Coven
*Attorney, Agent, or Firm*—Oblon, Fisher, Spivak, McClelland & Maier

[57] ABSTRACT

In a marking method of jetting a paint onto material to be marked through a stencil having formed thereon a group of openings of an optional pattern arrangement, a marking method and apparatus therefor characterized in that specific openings among the group of openings are shielded in accordance with a desired character to be marked.

9 Claims, 16 Drawing Figures

SELECTIVELY BLOCKED MATRIX-FORM STENCIL AND METHOD OF USE

BACKGROUND OF THE INVENTION

1. Field of the Invention

In a stencil type marking apparatus using a stencil having formed thereon a group of openings of an optional pattern arrangement wherein the stencil is put onto a material to be marked and a paint is then sprayed through the stencil to perform the automatic marking, the invention therein relates to a marking method and apparatus for marking the material to be marked by shielding unnecessary openings in accordance with the content to be marked.

2. Description of the Prior Art

There have heretofore been proposed a number of methods and apparatuses for spraying a paint through a stencil in accordance with characters, marks or the like, but all of them require either the production of a stencil corresponding to characters, marks, etc. to be marked or the setting of a stencil prepared in advance between a paint spray nozzle and a material to be marked every time marking is made.

The present invention is directed to elimination of these drawbacks of present prior art techniques.

SUMMARY OF THE INVENTION

The present invention contemplates to provide a method and apparatus which rapidly and accurately shields unnecessary openings among openings formed on a stencil.

A first embodiment to accomplish the abovementioned object and other objects of the invention relates to a marking method which, in the marking method of spraying a paint onto a material to be marked through a stencil having a group of openings arranged in an optional pattern, shields specific openings among the group of openings in accordance with desired characters to be marked.

A second embodiment of the invention relates to a marking method wherein specific openings among the group of openings of the stencil are shield by mechanical means using shield plates.

A third embodiment of the invention relates to a marking method wherein an air jet layer is formed in the specific openings among the group of openings so that when the paint is sprayed through the stencil, the paint is blown off and prevented from attaching to the surface of the material to be marked in the openings having the air jet layer formed therein:

A fourth embodiment of the invention relates to a marking apparatus which includes a stencil having a group of openings of an optional pattern arrangement, shield plates capable of retracting or rotating provided to the stencil so as to shield the group of openings and a paint spray gun provided to the stencil so as to oppose said openings.

A fifth embodiment of the invention relates to a marking apparatus wherein a spray box incorporating therein the stencil and the spray gun is fitted to an arm capable of elevating and rotating.

A sixth embodiment of the invention relates to a marking apparatus which includes a stencil having a group of openings of an optical pattern arrangement, an air nozzle for forming an air jet layer provided to each of the group of openings, an air feed pipe connected to the air nozzle, and a paint spray gun positioned to oppose the group of openings.

A seventh embodiment relates to a marking apparatus wherein a spray box incorporating therein the stencil and the spray gun is fitted to an arm capable of elevating and rotating.

An eighth embodiment of the invention relates to a stencil for marking having a group of openings of an optional pattern arrangement, an air nozzle for forming an air jet layer provided to each of the group of openings and an air feed pipe connected to the air nozzle.

A ninth embodiment relates to a marking method wherein scale attached to a surface of a hot material to be marked is removed by water jet, and the surface of said hot material is simultaneously cooled before marking is effected.

A tenth embodiment relates to a marking method wherein the temperature of a surface of a hot material to be marked is preliminarily detected, and the time duration of spraying paint onto the surface of the hot material to be marked is varied dependent on the surface temperature of the hot material to be marked.

An eleventh embodiment relates to a marking method wherein unused paint having been sprayed is recovered and recirculated for reuse.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

The present inventon will now be explained in further detail in conjunction with preferred embodiments thereof shown in the accompanying drawings.

Figure 1A:
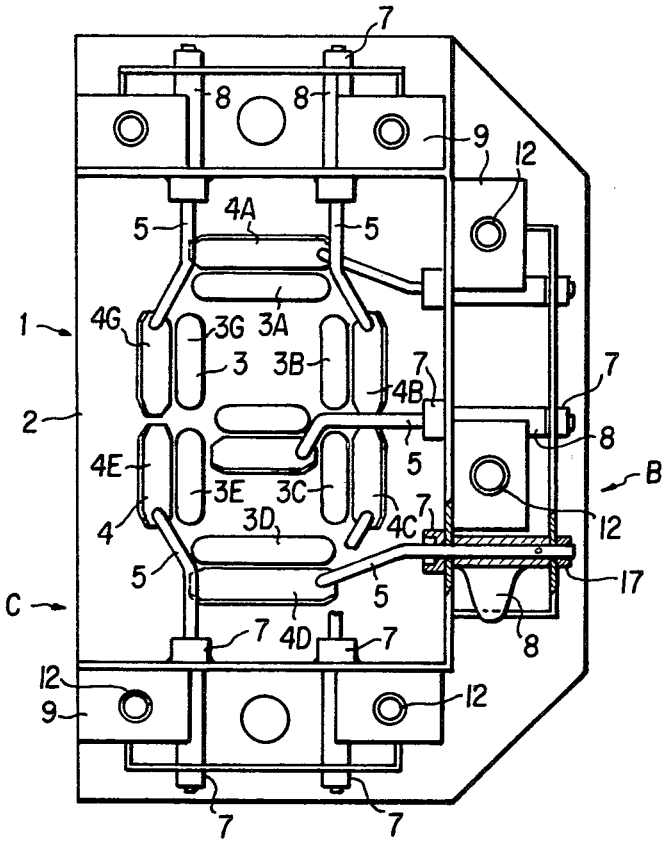
FIG. 1(A) is a plan view of a stencil for the marking apparatus in accordance with the present invention.
Figure 1B:
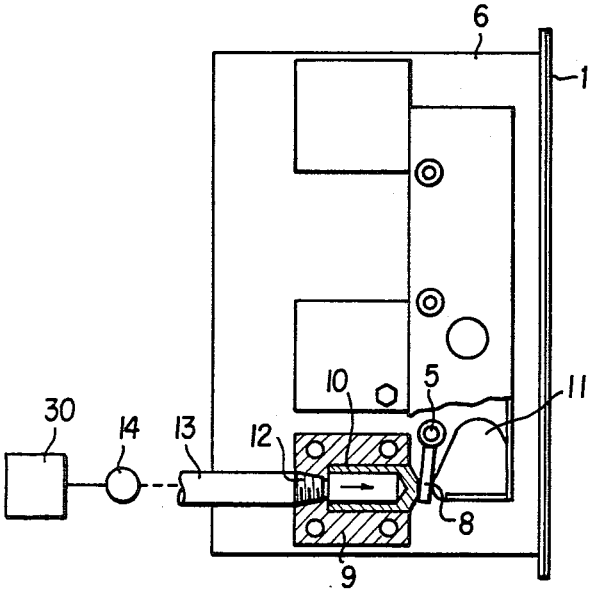
FIG. 1(B) is a side view as viewed from the direction indicated by arrow B of FIG. 1(A)
Figure 1C:
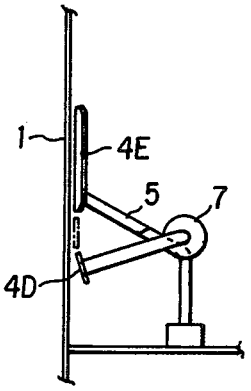
FIG. 1(C) is a side view as viewed from the direction indicated by arrow C of FIG. 1(A)

The stencil shown in FIGS. 1(A), 1(B) and 1(C) comprises a square flat metallic sheet 2 having seven elongated openings 3 (3A–3G) bored thereon to describe an "8" figure, and seven shield plates 4 (4A–4G) are provided on the external side of these openings so as to properly shield them from the upper surface. Each shield plate 4 (4A–4G) is secured to the bent tip of a shaft 5 (5A–5G), which is in turn pivoted by a bearing 7 secured to a support plate 6 protrusively adapted to the outer flange section of the support plate 6 so that when the shaft 5 rotates, the shield plate 4 is transferred from the open retreat position shown in the drawing to the close position at which it shields the respective opening 3 (3A–3G) from the upper surface. A lever 8 is secured to the linear portion of each shaft 5 interposed between the bearing 7 and an air cylinder 9 is secured to the support plate 6 at a position corresponding to each lever 8. The piston 10 of the air cylinder 9 is caused to butt the tip of the lever 8 and a leaf spring 11 is positioned to butt the lever 8 opposite to the piston 10.

Since the lever 8 is allowed to butt both piston 10 and leaf spring 11 in this manner, when the high pressure air is supplied to the air cylinder 9, the piston 10 is actuated in the direction indicated by an arrow in the drawing and causes the lever 8 to move up to the position indicated by the dotted line against the leaf spring 11 whereby the shaft 5 secured to the lever 8 is caused to rotate and hence, the shield plate 4 causes displacement up to the shield closed position. On the other hand, when the supply of the air is terminated, the lever 8 is pushed back by the leaf spring 11 to the position indicated by full line whereby rotation of the lever 8 causes displacement of the shield plate 4 to the open retreat position via the shaft 5.

An air hose 13 is connected to a high pressure air source 30 as well as a port of each air cylinder 9 and an electromagnetic valve 14 is interposed in the air hose so as to interrupt the supply of air to the port 12.

Incidentally, the actuation mechanism for actuating the shield plate 4 from the open retreat position to the closed shield position is not specifically limited to the abovementioned construction and various known mechanisms may likewise be used.

Figure 2A:
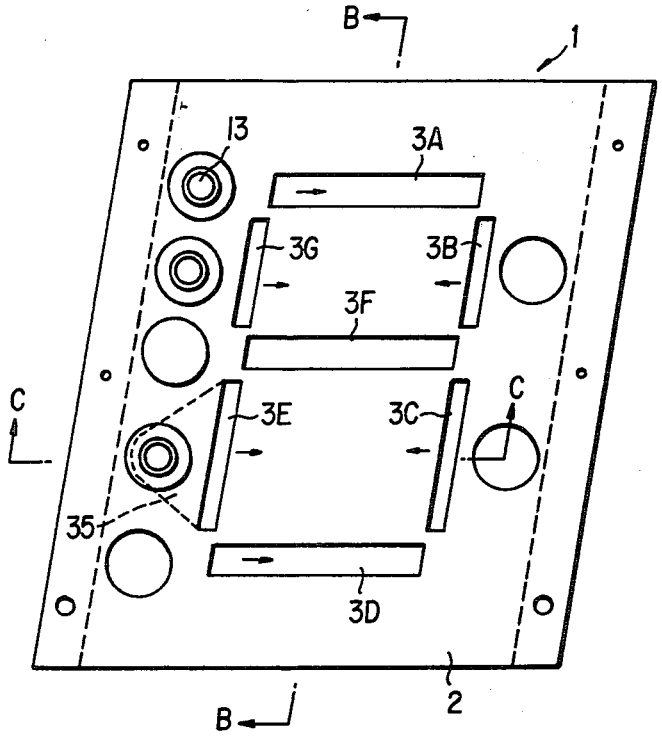
FIG. 2(A) is a plan view of a stencil for another embodiment of the marking apparatus in accordance with the present invention.
Figure 2B:
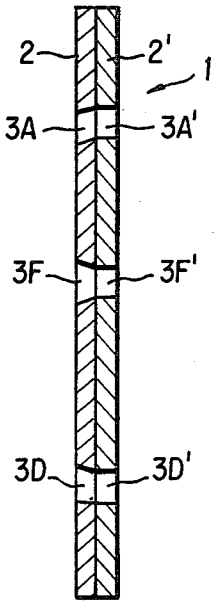
FIG. 2(B) is a sectional view taken along line B—B of FIG. 2(A)
Figure 2C:
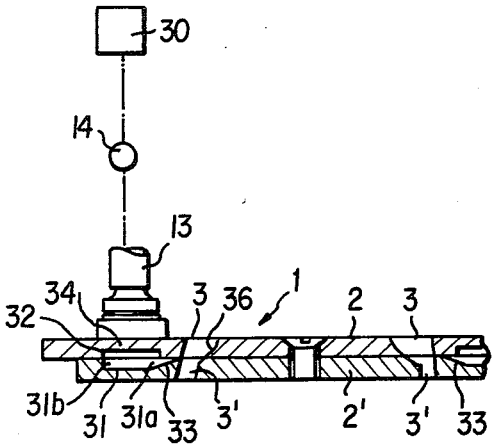
FIG. 2(C) is a sectional view taken along line C—C of FIG. 2(A)

The stencil 1 shown in FIGS. 2(A), 2(B) and 2(C) comprises a laminate of two metallic sheets 2, 2' wherein each metallic sheet has seven elongated openings 3, 3' (3A–3G, 3A'–3G') that coincide with one another when the two metallic sheets 2, 2' are superposed with each other. On the upper surface of the lower metallic sheet 2' is formed a groove 31 having a slant section 31*a* having a sectional area becoming progressively smaller towards the opening 3' in communication with the outer end on the right or left side of the opening 3' (for example, on the left hand end of the opening 3E' or on the left side end of the opening 3C' in the drawing) at the upper end portion thereof. On the other hand, on the lower surface of the upper metallic sheet 2 is formed a groove 32 having a sectional area in conformity with that of an outer portion 31*b* of a larger sectional area of the abovementioned groove 31. When the two metallic sheets 2, 2' are superposed, these grooves 31, 32 communicate with each other and form an outer air reservoir 35 and an air nozzle 33 in communication with the air reservoir 35 and with the openings 3, 3'.

An air feed port 34 is bored on the bottom surface of the groove 32 of the upper metallic sheet 2 and connected with the high pressure air hose 13 in fluid communication with the air source (not shown). A flow passage valve 14 consisting of an electromagnetic valve is interposed in the air hose 13. When the valve 14 is opened, the air is supplied to the openings 3, 3' from the air nozzle 33 in the directions indicated by arrows to thereby form an air jet layer. A guide 36 is formed on the inner wall surface of each opening 3, 3' opposite the air nozzle 33 and inclined upwardly to thereby define a large diameter portion as shown in the drawing so that the air jetted from the air nozzle 33 is blown upwardly along the air guide 36.

Additionally, the stencil 1 is not particularly restricted to the abovementioned shape. For example, only the air feed port 34 is formed on the upper metallic sheet 2 without the groove 32 and be communicated with the groove 31 of the lower metallic sheet 2'. Furthermore, the air feed port may be provided on the bottom surface of the groove 32 of the lower metallic sheet 2', thereby eliminating both groove 32 and port 34 of the upper metallic sheet 2. It follows naturally without specific notation that the shape, number and arrangement of the openings 3, 3' may be optionally modified.

Figure 3A:
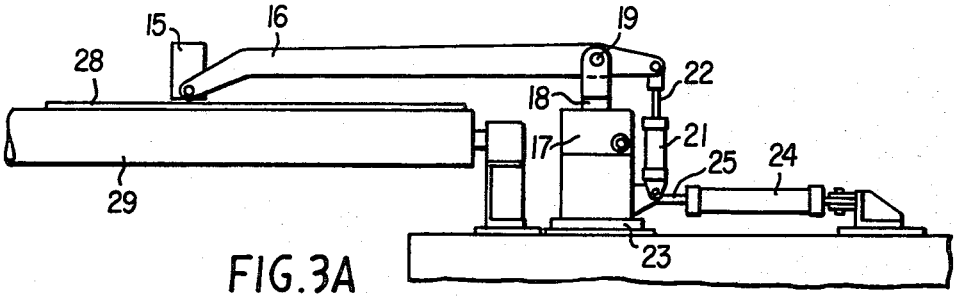
FIG. 3(A) is a front view of the overall construction of the marking apparatus in accordance with the present invention.
Figure 3B:
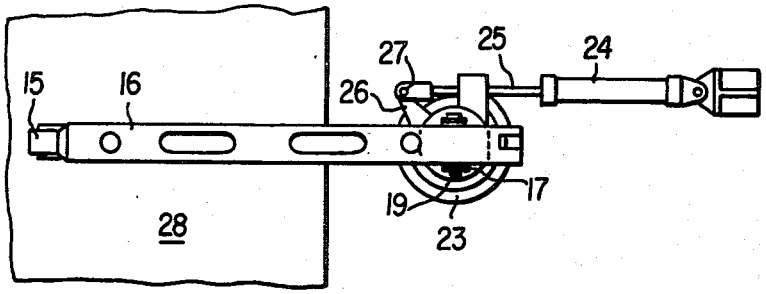
FIG. 3(B) is a plan view of FIG. 3(A)
Figure 3C:
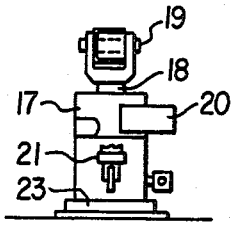
FIG. 3(C) is a side view of FIG. 3(A)

As shown in FIGS. 3(A), 3(B) and 3(C), the abovementioned stencil 1 is incorporated in a spray box 15 together with a spray gun (not shown) wherein the spray gun is secured to the upper portion of the stencil 1. The spray box 15 is pivoted at the tip of an arm 16 of which portion near its base end is turnably connected, via a pin 19, to a support shaft 18 that protrudes beyond the upper end of a frame 17 and is turnable in the horizontal direction. A motor 20 is mounted onto the frame 17 so as to turn the support shaft 18 in the horizontal direction. In the interlocking arrangement with rotation of the support shaft 18, the arm 16 and the spray box 15 also are caused to turn by a fine angle and move to a desired position. An air cylinder 21 for upward lifting is fitted to the frame 17 and the upper end of an operation rod 22 protruding from its upper end is fitted to the base end of the arm 16 so that the arm 16 rotates with a pin 19 being its support point and the spray box 15 at the tip of the arm 16 moves up and down along with the elevating action of the rod 22. The frame 17 itself is implanted onto a base 23 and is turnable in the horizontal direction. An air cylinder 24 for horizontal revolution is secured to the base and a rod 25 at its tip is connected to a lever 26 secured to the frame 17 via a pin 27 so that the frame 17 rotates by 90° in accordance with the extension and retraction of the rod 25 and places the arm 17 at a waiting inspection position and a marking position. In the drawing, reference numeral 28 designates a material to be marked and 29 denotes a roller table for conveying the materials 28 to be marked.

The explanation will now be given on the marking work in the above-described apparatus. First, the tip of the arm 16 is raised by the cylinder 21 for lifting, thereby lifting up the spray box 15. Next, the arm is turned by the cylinder 24 for revolution from the waiting position to the work position and at the same time, the material 28 to be marked is transferred from the roller table 29 to the predetermined work position. Thereafter, the tip of the arm 16 is lowered by the lifting cylinder 21 so as to allow the spray box 15 to approach the material 28 to be marked. Using the motor 20 the arm 16 is caused to rotate by a fine angle via the support shaft 18 and the spray box 15 is located at the predetermined position.

Figure 4:
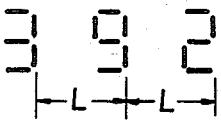
FIG. 4 is a schematic view of the characters marked in accordance with the method of the present invention.
Figure 5:
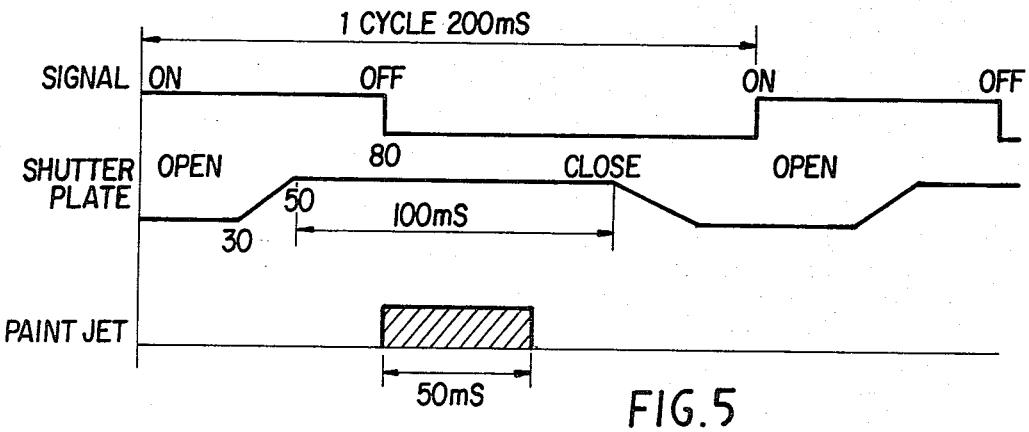
FIG. 5 is a diagram showing each operation cycle of the marking work in accordance with the method of the present invention.

In order to mark the necessary picture elements of the stencil 1, for example, a character "3" after location is completed in the abovementioned manner, the electromagnetic valve 14 of the air hose 13 communicated with the openings 3G, 3E is opened to feed the high pressure air into the cylinder 9. As the piston 10 is lowered in the direction indicated by the arrow in the drawing and turns the lever 8, the shield plates 4G, 4E move over the openings 3G, 3E via the shaft 5 and shield them. Next, when the paint is jetted from the spray gun, the paint is applied onto the material 28 to be marked only through the necessary openings 3A, 3B, 3C, 3D and 3F, thereby marking the character "3" on the material as shown in FIG. 4. After the jetting of the paint, the electromagnetic valve 14 that has been open is closed and the feed of air to the air cylinder 9 is terminated whereby the lever 8 is caused to return by the leaf spring 11 and the shield plates 4G, 4E are moved to their retreat positions via the shaft 5.

Incidentally, the time required for a series of the abovementioned marking work is extremely short, i.e., about 30–50 msec. for the paint spray and up to 0.1 sec. for the feed of the high pressure air. Also, the action time of the shield plate 4 is extremely short, that is, it takes only up to 50 msec. for the shield plate 4 to close (shield) the opening 3 from the feed of the valve opening signal to the electromagnetic valve 15 and up to 100 msec. to open the opening 3 from the valve closing signal. In this case, it is possible to carry out the marking work at a marking cycle of 0.2 sec/character.

Since the spray time of the paint is extremely short, it is possible to perform marking even if there exists a relative speed of not higher than 1 m/sec. between the material to be marked and the stencil at the time of marking. Hence, so-called "run-marking" is feasible. In this case, the gap L between the characters to be marked becomes longer in comparison with marking of the stationary material as illustrated in FIG. 4. Additionally, shielding of the opening may be made by means of the high pressure air in the same way as the abovementioned mechanical means.

Figure 6:
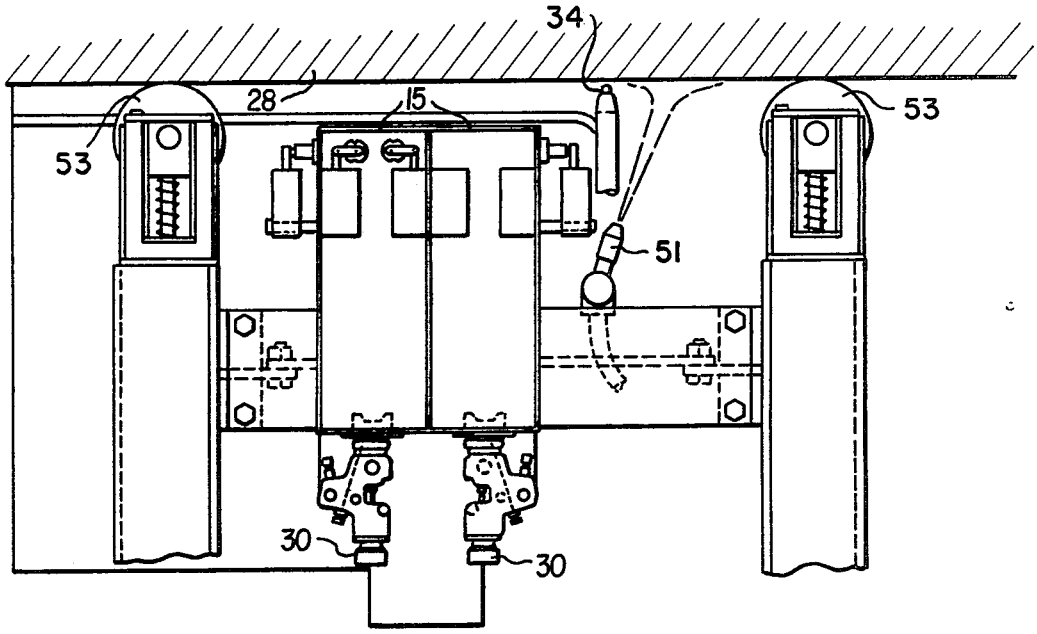
FIG. 6 is a plan view illustrating still other method of the present invention.

When material to be marked is hot material such as hot slab or hot billet, scale attached to the surface or skin of these materials should preferably be removed in order to effect stable marking, before marking operation. FIG. 6 shows specific steps to remove the scale before marking operation, wherein a marking apparatus provided with two spray boxes 15, 15, spray guns 30, 30, and descaling nozzle 51, is carried in an arrowed direction by means of rollers 53, 53. Scale on material surface to be marked is preliminarily removed by water jet ejected from the descaling nozzle 31, and at the same time the material surface to be marked is cooled to ensure stable marking.

Figure 7A:
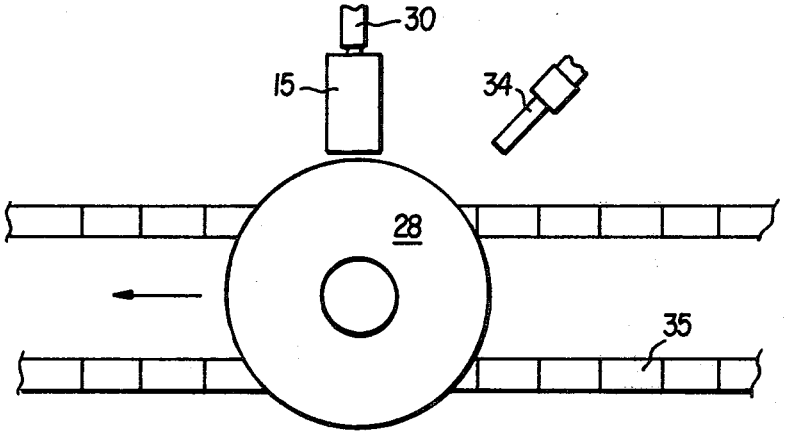
FIG. 7(A) is an explanatory view illustrating the other method of the present invention.
Figure 7B:
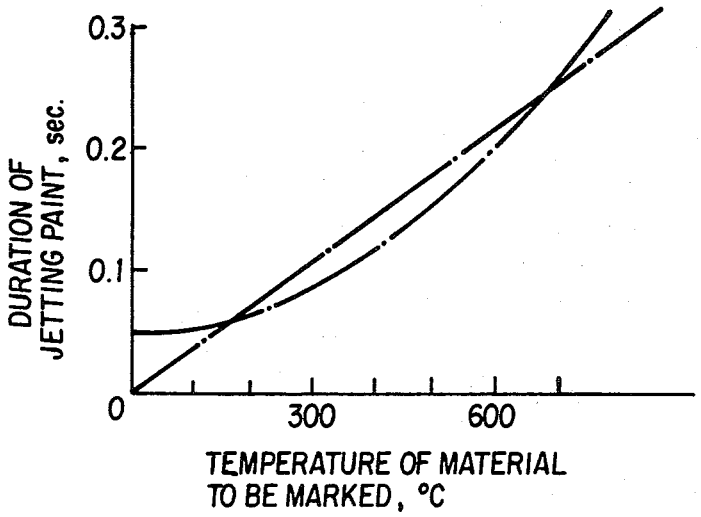
FIG. 7(B) is a curve showing an optimum relationship between surface temperature of a material to be marked and time duration of spraying paint.
Figure 7C:
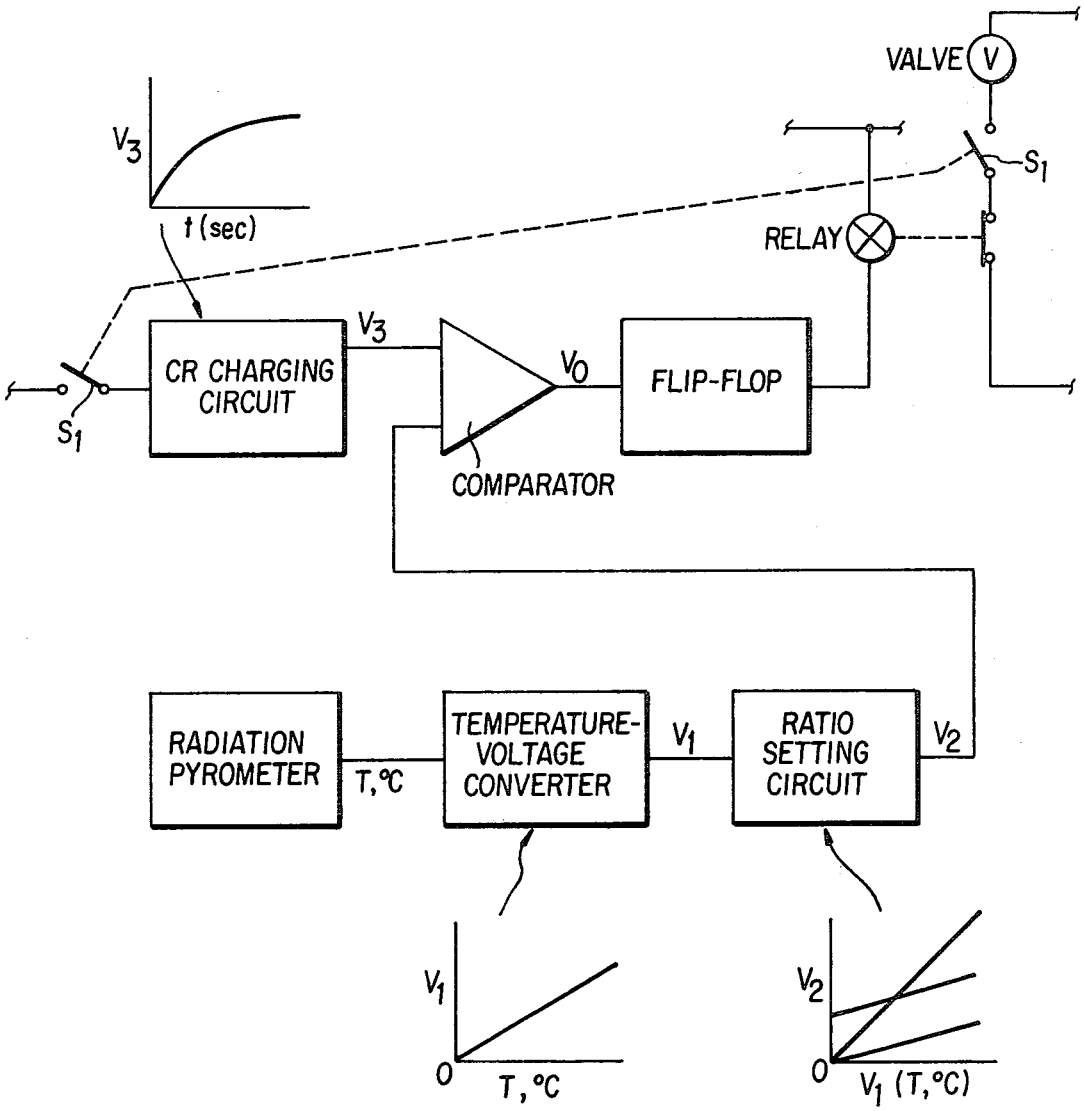
FIG. 7(C) is a block diagram of a control mechanism of a method of the present invention; and, FIG. 8 is a schematic explanatory view showing still further method of the present invention.

Now that hot rolled coil has a variety of temperature ranging from 200° to 600° C. depending on size and heat treatment, it is necessary to increase an amount of paint to be sprayed on hot surface to be marked as the surface temperature increases. Namely, if the amount of paint sprayed from a spray gun is constant, time duration of spraying paint from the gun has to be extended. As shown in FIG. 7(A), when a hot coil 28 (i.e. material to be marked) travelling on a conveyor 35 is to be marked by means of spray box 15 and spray gun 30, surface temperature of the hot coil is detected first by a radiation pyrometer 34, and the thus detected temperature signal is converted into a voltage value $V_1$ by temperature-voltage converter shown in FIG. 7(C). Then $V_1$ is fed to ratio setting circuit in which an optimum value is to be set by reference to a curve shown in FIG. 7(B). Since this curve is simulated to a broken line without any substantial inconvenience, $V_2$ can be considered to represent an optimum setting value. The output $V_2$ of the ratio setting circuit is introduced to a comparator to compare with an output $V_3$ of CR charging circuit. The CR charging circuit generally consists of capacitance and resistance, being widely used for timer. There is a relationship as shown in a graph at the left upper portion of FIG. 7(C), between the output $V_3$ and time t.

Accordingly, the comparator compares $V_3$ variable depending on time with constant value $V_2$. If the whole circuit is so set as an intense signal generates at the output side of a flip-flop when $V_2 - V_3 =$ zero, a relay is actuated to turn off a spray electromagnetic valve V . Namely, as the temperature is low($V_2$ is small), $V_3$ may be small(duration of charging may be short), that is, time duration of spraying paint may be short.

As can be seen from the foregoing, stable and secured marking operation is achieved by choosing the amount of paint sprayed depending on the surface temperature of the hot material to be marked.

Figure 8:
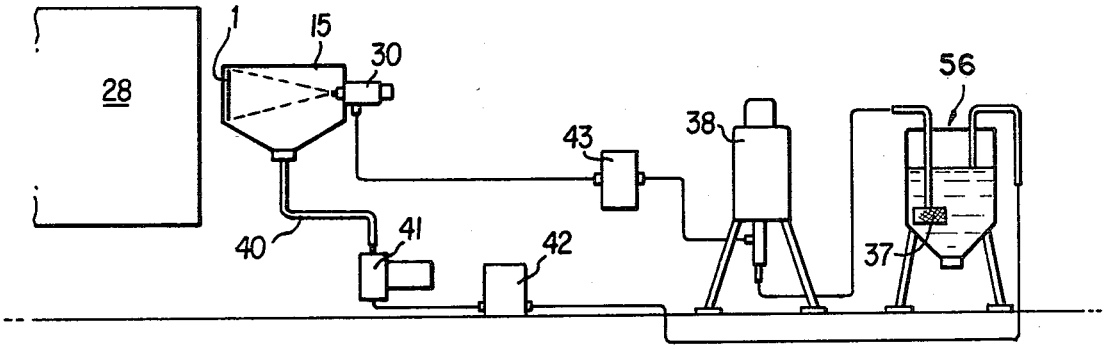

Finally, unused paint which has not reached to the surface of the material to be marked should preferably be recovered for saving paint and the other objects such as preventing dropping of paint from the spray box and so forth. As shown in FIG. 8, stored paint in paint tank 56 is fed to a spray gun 30 by means of pump 38 through a suction filter 37 and filter 43. The paint is then sprayed from the spray gun 30 towards spray box 15 to effect marking on the surface of material 28 to be marked though a stencil 1 provided at the top end of the spray box 15. While unused paint which has been prevented from reaching to the surface to be marked is recovered to the paint tank 36 via a hose 40, a diaphragm pump 41 and a filter 42 for recirculation of the paint and for reuse.

As can be appreciated clearly from the foregoing explanation, the marking method and apparatus in accordance with the present invention provide various advantages as listed below;

1. The apparatus is extremely simple in construction, facilitates maintenance and inspection, has less faults and can be produced economically.
2. Since switching operation of characters, figures, etc. of the stencil can be made within an extremely short time, marking of a number of characters, figures, etc. can be made using only one stencil.
3. The processing capacity is high and improves the production rate.
4. It is possible to perform marking of a running material or so-called "run-marking".
5. The stencil is made of a metal and has an extremely simple construction. In addition, since the stencil has no moving part, it has high heat resistance. Namely, it can perfectly withstand the temperature of the material to be marked exceeding 700°–800° C.

Obviously, many modifications and variations of the present invention are possible in light of the above teachings. It is therefore to be understood that within the scope of the appended claims the invention may be practiced otherwise than as specifically described herein.

What is claimed as new and desired to be secured by letters patent of the United States is:

1. A marking method of spraying paint onto a material to be marked through a stencil having a group of separate openings arranged in an optional pattern to form a predetermined character, said character comprising a single independently meaningful symbol, at least some of said openings not individually forming independently meaningful symbols, said method comprising the steps of:

positioning a paint spray source in operative relation to said openings;

positioning said stencil between said source of spray paint and said material;

utilizing plate means to close all of said openings not needed to form said character to be marked; and forming said character by spraying said paint adjacent said stencil for a finite period of time;

whereby said material is not marked through those openings which are closed.

2. The marking method of claim 1 further comprising removing scale attached to a surface of a hot material to be marked by water jet, and simultaneously cooling the surface of said hot material before marking is effected.

3. The marking method of claim 1 further comprising recovering and recirculating unused paint having been previously sprayed.

4. A marking method of spraying paint onto a material to be marked through a stencil having a group of separate openings arranged in an optional pattern, said method comprising the steps of:

positioning a paint spray source in operative relation to said openings;

positioning said stencil between said source of spray paint and said material;

forming a jet layer of air in selected ones of said openings according to the character to be marked, said layer moving parallel to the surface of said material; and spraying said paint adjacent said stencil for a finite period of time;

whereby said material is not marked through those openings which have said layer.

5. A marking apparatus for a material, comprising:

a stencil having formed thereon a group of separate openings in an optional pattern, to form a predetermined character, said character comprising a single independently meaningful symbol, at least some of said openings not individually forming independently meaningful symbols, said stencil being positionable adjacent said material;

a shield plate for each of said openings, each said shield plate movably mounted to said stencil in such a manner that it can be moved to a position which covers and closes off its respective opening;

means for selectively moving said shield plates for all of said openings not needed to form said predetermined character to said covering position;

a paint spray gun operatively directed towards said material and having said stencil positioned therebetween; and means for causing said paint spray gun to spray paint towards said material for a finite period of time;

whereby said material is not marked by said paint through those openings which are covered by said shield plates.

6. The marking apparatus of claim 5 which further comprises a spray box incorporating therein said stencil and an arm to which said spray box is mounted including means capable of elevating and rotating said spray box.

7. A marking apparatus for a material, comprising:

a stencil having formed thereon a group of separate openings in an optional pattern, said stencil being positionable adjacent said material;

an air nozzle operatively associated with each said opening of said stencil and positioned for forming a jet layer of air in its respective opening, said jet layer moving parallel to the surface of said material;

means for selectively supplying air to each of said openings to form said layer;

paint spray means operatively directed towards said material and having said stencil positioned therebetween; and means for activating said paint spray means;

whereby said material is not marked by said paint through said openings having said layer.

8. The marking apparatus of claim 7 which further comprises an arm including means capable of elevating and rotating and a spray box mounted to said arm incorporating therein said stencil.

9. A marking method of spraying paint onto a material to be marked through a stencil having a group of separate openings arranged in an optional pattern, said method comprising the steps of:

positioning a paint spray source in operative relation to said openings;

positioning said stencil between said source of spray paint and said material;

utilizing plate means to close selected ones of said openings in accordance with a character to be marked;

spraying said paint adjacent said stencil for a finite period of time; and preliminarily detecting the temperature of a surface of said material to be marked wherein said material to be marked is hot, and varying the duration of said finite period of time depending on the surface temperature of said hot material to be marked;

whereby said material is not marked through those openings which are closed.

* * * * *